US005467871A

United States Patent [19]

DeField

[11] Patent Number: 5,467,871

[45] Date of Patent: Nov. 21, 1995

[54] KEY CHAIN NOTE HOLDER WITH TRANSPARENT HOUSING

[76] Inventor: Norman DeField, 2641 Grand Ave., Billings, Mont. 59102

[21] Appl. No.: 300,760

[22] Filed: Sep. 6, 1994

[51] Int. Cl.[6] ..... A45C 11/32; G09F 3/20

[52] U.S. Cl. ..... 206/232; 206/38.1; 206/555; 206/37.1

[58] Field of Search ..... 206/224, 232, 206/38, 38.1, 449, 555, 37, 37.1; 40/642, 649, 651, 653, 654, 661

[56] References Cited

U.S. PATENT DOCUMENTS

| | | | |
|---|---|---|---|
| 1,025,007 | 4/1912 | Mieden | 206/232 |
| 1,487,433 | 3/1924 | Beckert | 206/232 |
| 1,530,070 | 3/1925 | Bovee | 206/232 |
| 2,226,969 | 12/1940 | D'Onofrio | 206/232 |
| 3,466,774 | 9/1969 | Borresen | 206/38 |
| 3,826,026 | 7/1974 | Bevan | 40/661 X |
| 4,413,434 | 11/1983 | Rupert et al. | 40/661 |
| 4,518,080 | 5/1985 | Ohlson | 206/39 |
| 4,524,871 | 6/1985 | Klinger | 206/38 |
| 4,616,435 | 10/1986 | Perfect | 40/642 X |
| 4,691,456 | 9/1987 | Ackeret | 40/642 |
| 4,700,840 | 10/1987 | Haddock | 206/37 X |
| 4,745,695 | 5/1988 | Hetzer | 40/661 |
| 4,746,045 | 5/1988 | Schweim | 40/661 X |
| 4,936,462 | 6/1990 | Yuen | 206/232 X |
| 5,000,327 | 3/1991 | Kincheloe | 206/232 X |
| 5,020,255 | 6/1991 | Rodel | 206/37.1 X |
| 5,038,926 | 8/1991 | van der Toorn | 206/39.3 |
| 5,060,794 | 10/1991 | Linn et al. | 206/232 |
| 5,183,153 | 2/1993 | Linn | 206/232 |

FOREIGN PATENT DOCUMENTS

| | | | |
|---|---|---|---|
| 1085354 | 7/1954 | France . | |
| 1394243 | 2/1965 | France | 206/232 |
| 386868 | 1/1933 | United Kingdom . | |

*Primary Examiner*—Jacob K. Ackun
*Attorney, Agent, or Firm*—David Pressman

[57] ABSTRACT

A key chain note holder includes a flat housing (10) having a transparent side (17) and an opaque side (18). An elongated slot (12) extends into the housing between the sides for slidably receiving a note card (13) having a white, reusable writing surface (13A), and a brightly colored opposite surface (13B). The housing also includes a hollow shaft (20) extending thereinto for slidably receiving an erasable marking pen (21), and another hole (14) for receiving a key ring (15) for carrying one or more keys (16). The note card and pen can be removed from the housing for note taking, and replaced therein for convenient storage when done. The note card can be reinserted into the slot with the writing surface facing the transparent side of the housing, so that the notes are conveniently visible; the housing also protects them from accidental erasure. Alternatively, the note card can be reinserted into the slot with the writing surface facing the opaque side of the housing to hide the notes for security, but the brightly colored opposite surface will be seen through the transparent side to positively alert the user to the presence of the notes. The note card can be removed from the slot, and the notes easily erased or wiped away with a cloth or tissue paper, so that the note card can receive new notes.

17 Claims, 4 Drawing Sheets

Fig. 1A
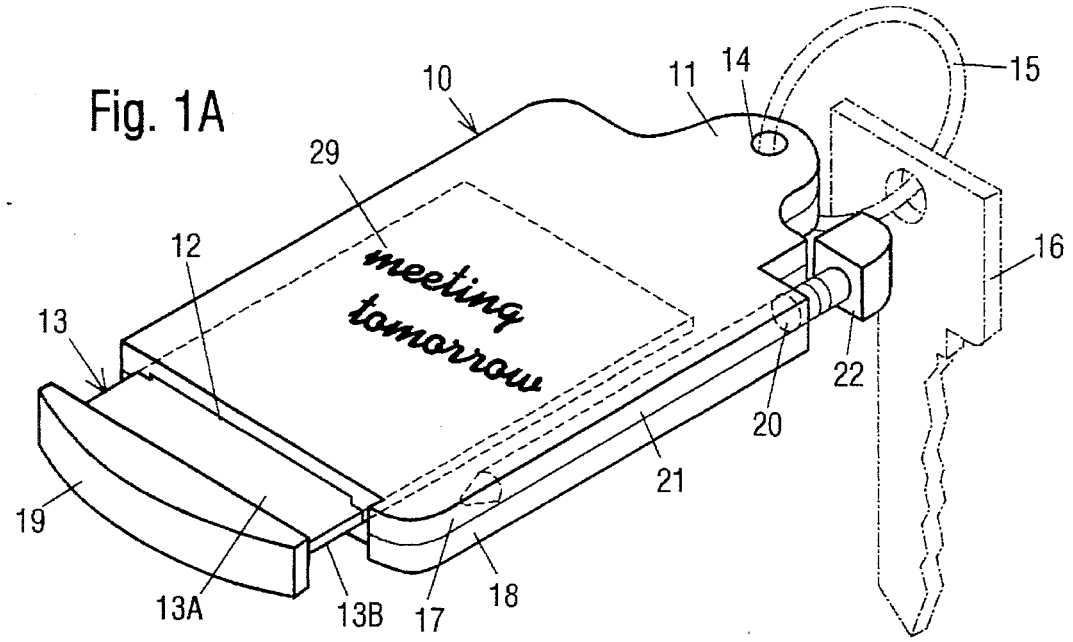
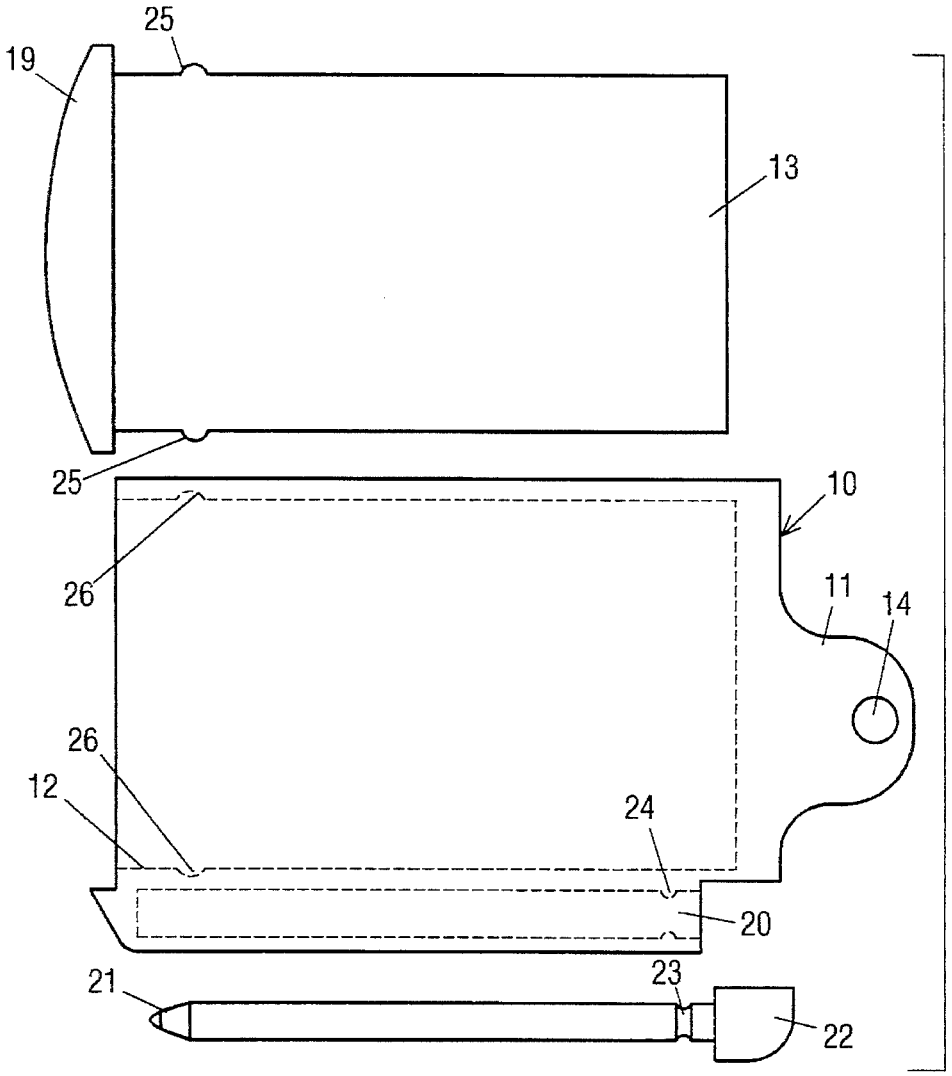
Fig. 1B

KEY CHAIN NOTE HOLDER WITH TRANSPARENT HOUSING

BACKGROUND

1. Field of Invention:

This invention relates generally to note recording devices, specifically to a key chain note card.

2. Prior Art:

A notepad is a stack of paper for receiving written notes. It is desirable to carry a notepad and a pen or pencil to make notes, reminders, etc. However, this is inconvenient because most notepads are too large to be carried in a pocket, and carrying a separate pen or pencil is troublesome. The notepad can get frayed if carried in a pocket. In addition, privacy or secrecy is difficult to maintain, because notes written on the top sheet are open to other's view when the notepad is exposed in public.

Various notepad holders have been proposed to overcome these disadvantages. U.S. Pat. Nos. 1,025,007 to Mieden (1912); 1,487,433 to Beckeft (1924); 1,530,070 to Bovee (1925); and 4,524,871 to Klinger (1985); as well as French patent 1,085,354 to Felsenbourg (1954) show fold-open booklets with a note card mounted onto one side, and one or more pens mounted in clips or slots. The notepads, and any notes written thereon, are normally hidden from view when the notebook is in the closed, storage position. Therefore the booklets must be opened before their notes can be read.

U.S. Pat. No. 5,060,794 to Linnet al. (1991) shows a frame that holds a notepad therein. The frame has an open face so that written notes on the top piece of notepaper are visible, and cannot be protected for privacy. Also the notepad is gradually used and depleted, so that it must be refilled periodically.

U.S. Pat. Nos. 4,518,080 to Ohlson (1985); and 5,038,926 to van der Toom (1991) show card holders or frames that securely surround the edges of a card, so that most of the card is visible. If they are used to hold notepaper, they can hold only a single piece; but if they are used to hold a reusable plastic notepad, the written notes may be inadvertently rubbed off from the exposed top surface of the card.

U.S. Pat. No. 2,226,969 to D'Onofrio (1940) shows a money clip that can be used for holding a notepad. If holds a reusable plastic notepad, the written notes may be inadvertently rubbed off from the exposed top surface of the card. French patent 1,394,243 to Seilinger (1965) shows a key chain pillbox with a sliding cover. If it is used to hold a notepad, the cover must be removed before notes can be written or read.

These and all other prior art notepads or card holders either cannot be read until they are opened, or they leave written notes exposed and subject to accidental erasure. Some use consumable notepads that must be periodically replaced, which are also too thick and heavy to conveniently carry in a pocket. Some notepads include no provision for carrying keys.

OBJECTS AND ADVANTAGES

Accordingly, several objects and advantages of the invention are to provide an improved note card, a note card which can be easily erased and reused, and a note card which prominently displays notes thereon without having to be opened, but which can also hide the notes from view for security.

Other objects and advantages of the invention are to provide a note card which conveniently stores a pen, which can provide a clear and unmistakable signal for indicating the presence of notes, which protects the notes from accidental erasure or smearing, which can be used to conveniently hold keys, and which is compact and easy to carry.

Additional objects and advantages will become apparent from a study of the following description and the accompanying drawings.

SUMMARY OF THE INVENTION

A key chain note card device includes a housing with a slot for slidably receiving a note card with a reusable writing surface, and a brightly colored, opposite surface. The housing includes one transparent side and one opaque side, and a hollow shaft for storing a marking pen. The note card is removed from the housing to receive notes written with the pen. The note card can be reinserted into the housing with either the written surface visible through the transparent side of the housing, so that the notes can be easily read; or it can be reinserted with the colored surface visible through the transparent side, so that the notes are hidden from view for security, but still positively alert the user to the presence of notes.

BRIEF DESCRIPTION OF THE DRAWING FIGURES

FIG. 1A is a front perspective view of a key chain note card in accordance with a first embodiment of the invention.

FIG. 1B is an exploded top view of the note card of FIG. 1A.

DRAWING REFERENCE NUMERALS

Figure 1C:
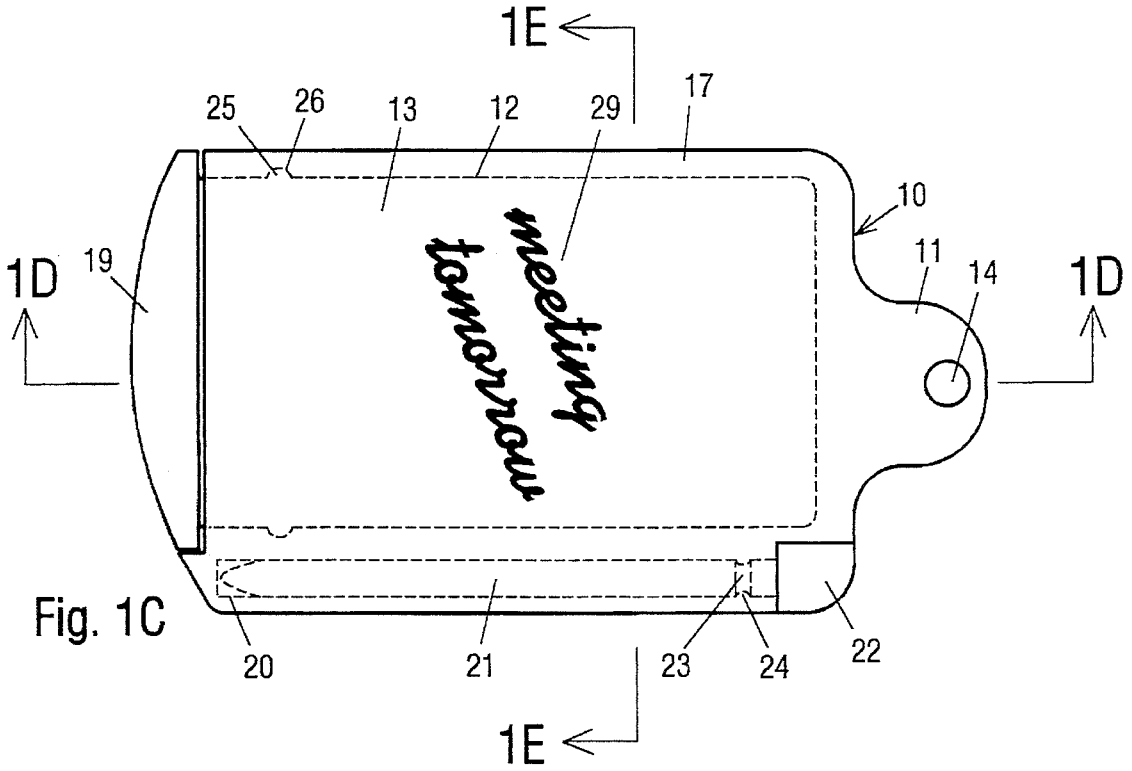
FIG. 1C is a top view of the note card of FIG. 1A when fully assembled.

| | | | |
|---|---|---|---|
| 10. | Housing | 11. | Tab |
| 12. | Slot | 13. | Note Card |
| 13A. | Writing Surface | 13B. | Brightly Colored Surface |
| 14. | Hole | 15. | Key Ring |
| 16. | Key | 17. | Transparent Side |
| 18. | Opaque Side | 19. | Grip Member |
| 20. | Hollow Shaft | 21. | Pen |
| 22. | Grip Member | 23. | Annular Groove |
| 24. | Annular Ridge | 25. | Nubs |
| 26. | Notches | 27. | Thick Portion Of Note Card |
| 28. | Shoulders | 29. | Note |
| 40. | Housing | 41. | Tab |
| 42. | Slot | 43. | Note Card |

-continued

| | | | |
|---|---|---|---|
| 43A. | Writing Surface | 43B. | Brightly Colored Surface |
| 44. | Hole | 45. | Key Ring |
| 46. | Key | 47. | Transparent Side |
| 48. | Opaque Side | 49. | Grip Member |
| 50. | Hollow Shaft | 51. | Pen |
| 52. | Grip Member | 53. | Annular Groove |
| 54. | Annular Ridge | 55. | Nubs |
| 56. | Notches | 57. | Thick Portion Of Note Card |
| 58. | Shoulders | 59. | Note |

DESCRIPTION—FIG. 1A—FIRST EMBODIMENT FRONT VIEW

In accordance with a first embodiment of the invention as shown in the front perspective view in FIG. 1A, a key chain note holder includes a flat, generally rectangular housing 10 with a tab 11 extending away from one end, and a slot 12 extending into an opposite end for receiving a reusable note card 13 (shown partially inserted) made of a smooth, non-porous material, such as plastic. Tab 11 includes a through hole 14 for receiving a key ring 15, which can be used to carry a key 16; additional keys can be carried if desired. Alternatively, ring 15 can be dedicated to the key chain notes card and hooked around a larger ring (not shown), along with keys such as 16. Note card 13 includes a white, writing surface 13A, and an opposite surface 13B of a bright color, such as red, blue, yellow, orange, etc.

Housing 10 includes a transparent top side 17, which can be made of acrylic, or any other suitable material; and an opposite, opaque bottom side 18, which can be made of ABS (acrylic-butyl-styrene) plastic, or any other suitable material. Attached to the outer edge of note card 13 is an enlarged grip member 19, which does not go into slot 12, so that card 13 can be easily pulled out. Housing 10 also includes a hollow shaft 20 for slidably receiving a marker pen 21 (shown partially inserted) used for writing information such as note 29 on note card 13. Pen 21 includes an enlarged head or grip member 22, which does not go into shaft 20, so that it can be easily withdrawn for use. Pen 21 preferably has a small felt pointed tip and is arranged to write a highly visible line on card 13, which can be easily erased from card 13 by rubbing it with a soft cloth or tissue paper (not shown).

In this embodiment, the key chain note card is about 100 mm long, 54 mm wide, and 8 mm thick. It is small enough to be conveniently carried on a key chain in a pocket or purse.

DESCRIPTION—FIG. 1B—EXPLODED TOP VIEW

In the exploded top view of FIG. 1B, pen 21 includes an annular groove 23 disposed near grip member 22. An annular ridge 24 is formed in hole 20 near its entrance. Note card 13 includes a pair of semi-circular nubs 25 extending from its sides. Slot 12 includes a pair of semi-circular notches 26 formed into its side edges.

DESCRIPTION—FIG. 1C—ASSEMBLED TOP VIEW

The key chain note card is shown assembled in the top view in FIG. 1C. Pen 21, which is made of a slightly resilient plastic, such as ABS, is inserted and securely held within hole 20 when annular groove 23 snaps around annular ridge 24. Note card 13, which is also made of a slightly resilient plastic, is inserted and securely held within slot 12 when nubs 25 snap into corresponding notches 26.

DESCRIPTION—FIG. 1D—SIDE SECTIONAL VIEW

Figure 1D:
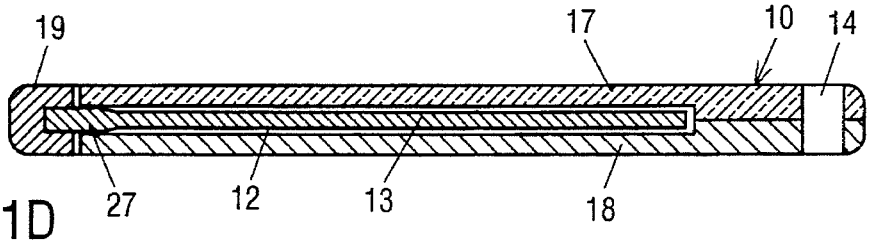
FIG. 1D is a side sectional view of the note card taken along line 1D—1D in FIG. 1C.

As shown in the side sectional view in FIG. 1D, note card 13 includes a thicker portion 27 sized for providing a frictional fit within the entrance of slot 12.

DESCRIPTION—FIG. 1E—END SECTIONAL VIEW

Figure 1E:
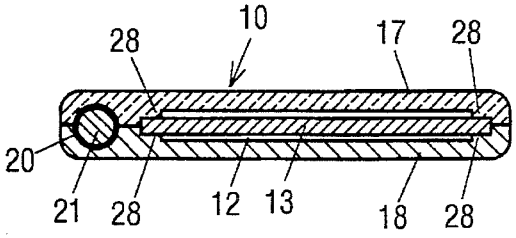
FIG. 1E is an end sectional view of the note card taken along line 1E—1E in FIG. 1C.

As shown in the end sectional view in FIG. 1E, slot 12 includes a pair of shoulders 28 formed along each of its edges for spacing the surfaces of note card 13 from the corresponding surfaces of slot 12, so that notes written on note card 13 will not be scraped off or smeared.

DESCRIPTION—FIG. 2A—SECOND EMBODIMENT FRONT VIEW

Figure 2A:
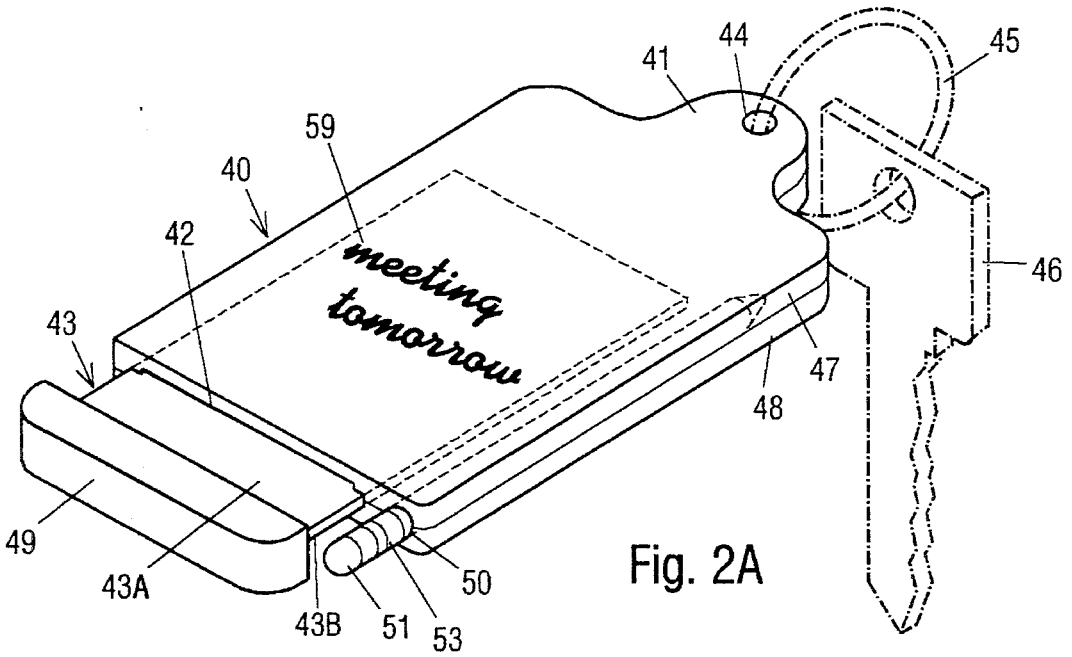
FIG. 2A is a front perspective view of a key chain note card in accordance with a second embodiment of the invention.

In accordance with a second embodiment of the invention as shown in the front perspective view in FIG. 2A, a key chain note holder includes a flat, generally rectangular housing 40 with a tab 41 extending away from one end, and a slot 42 extending into an opposite end for receiving a reusable note card 43 (shown partially inserted) made of a smooth, non-porous material, such as plastic. Tab 41 includes a through hole 44 for receiving a key ring 45, which can be used to carry a key 46; additional keys can be carried if desired. Note card 43 includes a white, writing surface 43A, and an opposite surface 43B of a bright color, such as red, blue, yellow, orange, etc.

Housing 40 includes a transparent top side 47, which can be made of acrylic, or any other suitable material; and an opposite, opaque bottom side 48, which can be made of ABS plastic, or any other suitable material. Attached to the outer edge of note card 43 is an enlarged grip member 49, which does not go into slot 42, so that card 43 can be easily pulled out. Housing 40 also includes a hollow shaft 50 for slidably receiving an erasable marker pen 51 (shown partially inserted) used for writing note 59 on note card 43.

In this embodiment, the holder is about 100 mm long, 54 mm wide, and 8 mm thick. It is small enough to be conveniently carried as a key chain in a pocket or purse.

DESCRIPTION—FIG. 2B—EXPLODED TOP VIEW

Figure 2B:
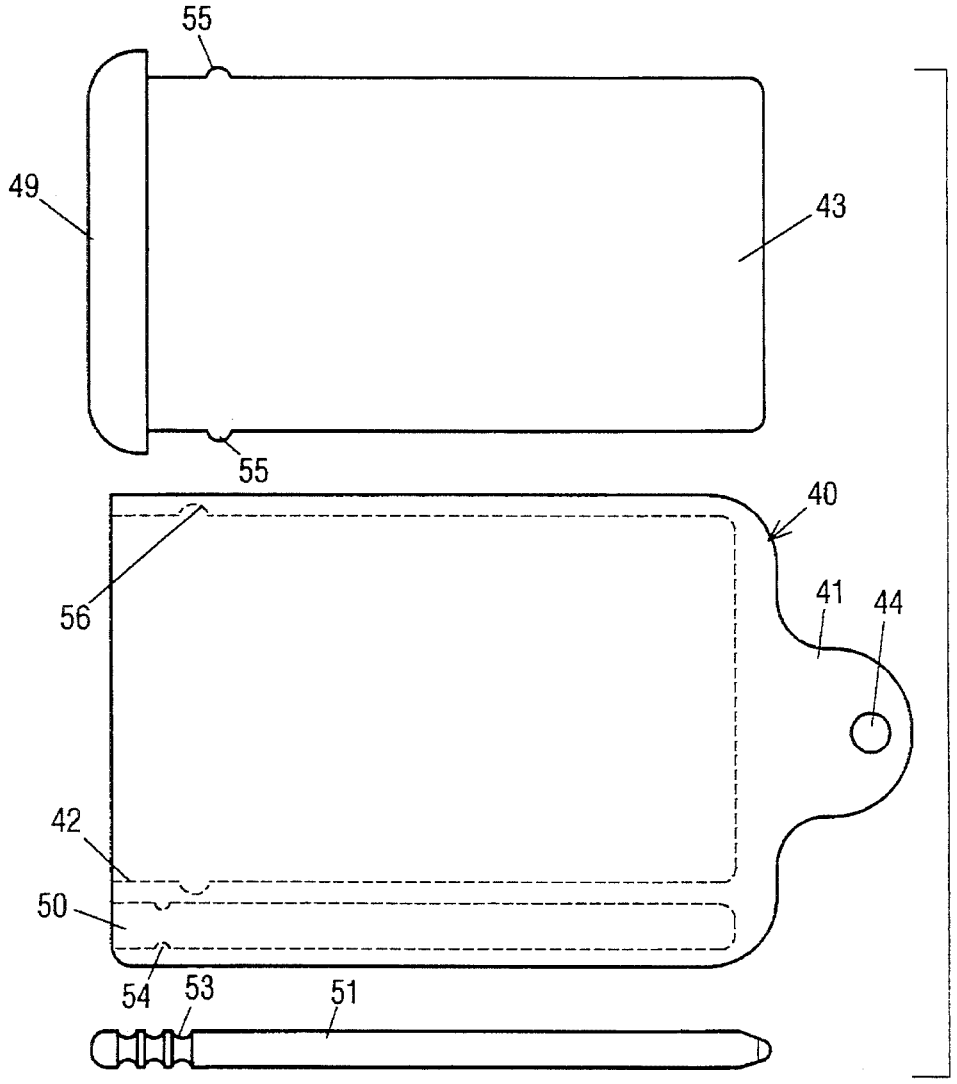
FIG. 2B is an exploded top view of the note card of FIG. 2A.

In the exploded top view of FIG. 2B, pen 51 includes a series of annular grooves 53 disposed near its left end. An annular ridge 54 is formed in hole 50 near its entrance. Note card 43 includes a pair of semi-circular nubs 55 extending from its sides. Slot 42 includes a pair of semi-circular notches 56 formed into its side edges.

DESCRIPTION—FIG. 2C—ASSEMBLED TOP VIEW

Figure 2C:
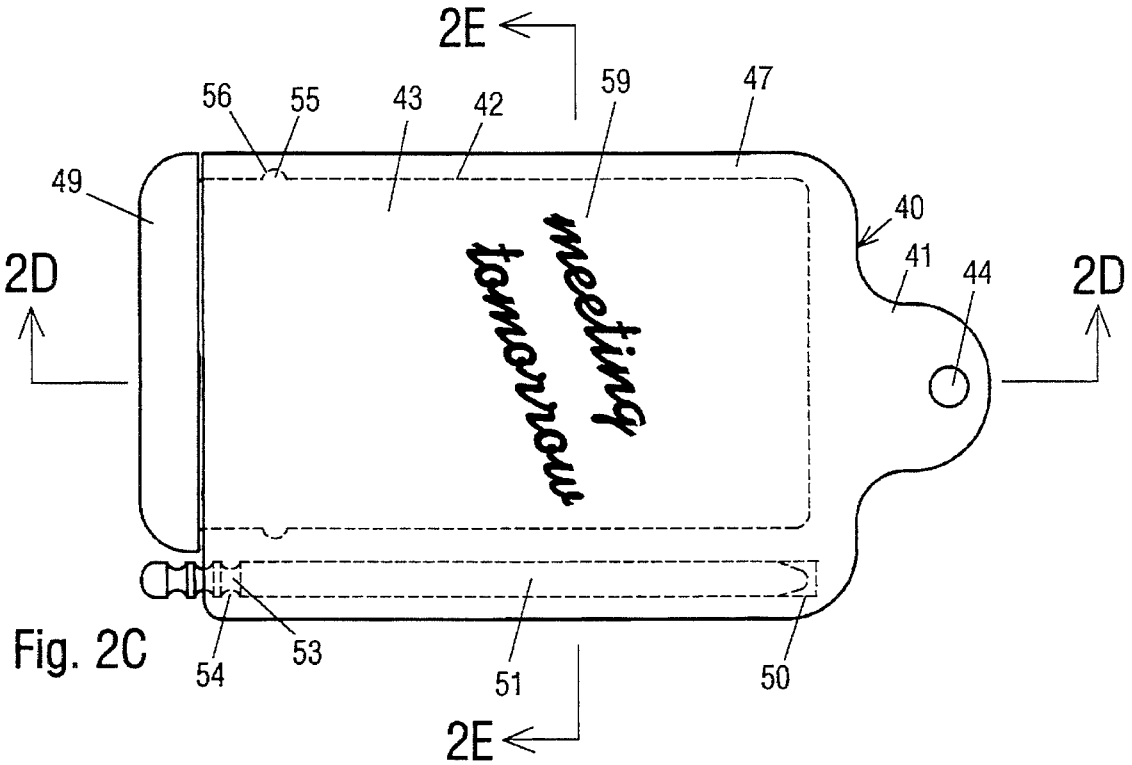
FIG. 2C is a top view of the note card of FIG. 2A when fully assembled.

The key chain note holder is shown assembled in the top view in FIG. 2C. Pen 51, which is made of a slightly resilient plastic, such as ABS, is inserted and securely held within hole 50 when annular groove 53 snaps around annular ridge 54. Note card 43, which is also made of a slightly resilient plastic, is inserted and securely held within slot 42 when nubs 55 snap into corresponding notches 56.

DESCRIPTION—FIG. 2D—SIDE SECTIONAL VIEW

Figure 2D:
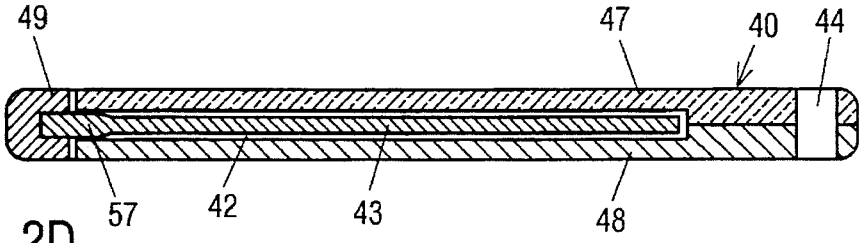
FIG. 2D is a side sectional view of the note card taken along line 2D—2D in FIG. 2C.

As shown in the side sectional view in FIG. 2D, note card 43 includes a thicker portion 57 sized for providing a frictional fit within the entrance of slot 42.

DESCRIPTION—FIG. 2E—END SECTIONAL VIEW

Figure 2E:
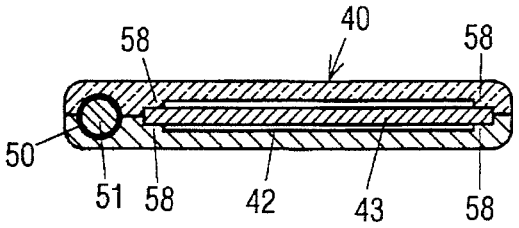
FIG. 2E is an end sectional view of the note card taken along line 2E—2E in FIG. 2C.

As shown in the end sectional view in FIG. 2E, slot 42 includes a pair of shoulders 58 formed along each of its edges for spacing the surfaces of note card 43 from the corresponding surfaces of slot 42, so that notes written on note card 43 will not be scraped off or smeared.

OPERATION—BOTH EMBODIMENTS

Both embodiments of the key chain note holder are used in the same way, so that only the first embodiment (FIGS. 1A to 1E) will be described below as an example.

The key chain note holder is normally stored or carried in the condition shown in FIG. 1 C, i.e., pen 21 and note card 13 are both fully inserted into hole 20 and slot 12, respectively. When a user wishes to record notes, pen 21 and card 13 are removed from housing 10, so that pen 13 can be used to write exemplary note 29 on writing surface 13A, as shown in FIG. 1A. After note 29 is written, pen 21 is reinserted into hole 20, and note card 13 is reinserted into slot 12 with writing surface 13A visible through transparent side 17 of housing 10, so that note 29 can be easily read without removing note card 13 therefrom. Alternatively, card 13 can be reinserted into slot 12 with brightly colored, opposite surface 13B visible through transparent side 17 to hide note 29 for privacy, but still positively alert the user to its presence. In either situation, housing 10 protects note 29 from accidental smearing or erasure, but after card 13 is removed from slot 12, it can be easily cleaned with a cloth or tissue paper so that it can be reused.

As shown in FIG. 1A, ring 15 with key 16 can be attached to tab 11 so that the note card device can also be used as a key chain fob.

CONCLUSION, RAMIFICATIONS, AND SCOPE

Accordingly the reader will see that I have provided an improved key chain note card. It conveniently stores a pen for writing. It includes a reusable surface for receiving notes, which can be easily erased or wiped off with cloth or tissue paper. It protects written notes from accidental erasure or smearing. It prominently displays written notes so that they can be easily viewed. It can also hide notes from view for security, but still positively alerts the user to their presence so that they will not be forgotten. It can receive a key ring for conveniently holding one or more keys, and it is small enough to carry in a pocket or purse.

Although the above descriptions are specific, they should not be considered as limitations on the scope of the invention, but only as examples of the preferred embodiment. Many additional ramifications and variations are possible within the teachings of the invention. For example, the entire housing can be transparent, and both sides of the note card can be white for receiving notes. The housing can be cylindrical for concentrically receiving a cylindrical note card, which is rotated to display notes through a window on the housing. The housing can also be of other shapes, such as oval or triangular. Two lateral, cylindrical housings can be connected by a rectangular channel, like a film cassette, and a flexible, elongated note card or tape is scrolled from one cylinder to the other for displaying notes through a window on the channel. Instead of a note card slidably positioned under a fixed, transparent window, the housing can be a shallow box for holding a note card, which is covered by a hinged, transparent cover. Instead of being entirely plastic, the note card can be made of cardboard and covered with a sheet of celluloid for erasably receiving ink. The housing can be made of other suitable materials, such as polystyrene, glass, etc., and it can also have different dimensions. Other types of locking devices can be used for securing the note card and the pen in the housing. In lieu of the marking pen with the felt tip, a pencil, chalk, ball point pen, or stylus can be provided, and in lieu of a flat plastic note card, a pad of paper sheets, a slate, a computer marking tablet (with suitable connections to a host computer), or a magic market pad can be used.

Therefore the scope of the invention should not be determined by the examples given, but by the appended claims and their legal equivalents.

I claim:

1. A note card apparatus, comprising:

a flat, rigid note card having two opposing major surfaces, a first of said surfaces being erasable and arranged to receive handwritten notes thereon such that said notes can be erased from said first surface, a rigid, hollow housing having an elongated slot extending into said housing and shaped and sized to receive said note card therein, said hollow housing being flat and having first and second major sides so that when said note card is inserted into said slot of said housing, each of said major sides of said housing will be adjacent one of said opposing major surfaces of said note card, said hollow housing and said note card including cooperating locking means for locking said note card within said housing for holding said note card to resist withdrawal thereof from said housing when said note card is fully inserted into said housing, but for allowing said note card to be withdrawn from said housing by manual force after it is fully inserted into said housing, said note card being shaped to be insertable into said slot of housing in either of first and second orientations such that, in said first orientation, said first and second surfaces of said note card are adjacent said first and second sides of said housing, respectively, and in said second orientation, said first and second surfaces of said note card are adjacent said second and first sides of said housing, respectively, said note card having an outer edge which includes a grip portion for facilitating grasping said note card for pulling it out of said housing, one of said two major sides of said hollow housing being transparent so that when said note card is positioned in said housing, said transparent side displays an adjacent major surface of said note card therethrough and also protects any writing on said note card from accidental erasure, and a hole extending through said housing, said hole adapted to receive a holding ring, said housing having a recess extending into said housing for removably receiving an elongated writing instrument, and locking means for securely locking said writing instrument within said recess, whereby said notes can be written on said writing surface when said note card is out of said housing and said note card can be inserted into said slot so that said writing surface is adjacent said transparent side so that said notes are visible therethrough, and said note card can also be inserted into said slot with said writing surface facing said opaque side so that said notes are hidden from view for security, and said housing protects said notes from accidental erasure when said note card is received therein.

2. The note card apparatus of claim 1 wherein said writing surface of said note card is made of a smooth, nonporous material adapted to removably receive said notes thereon.

3. The note card apparatus of claim 2 wherein said material is plastic.

4. The note card apparatus of claim 2 wherein said elongated slot includes opposite planar surfaces and opposite side edges, each of said opposite side edges including a pair of spaced-apart shoulders extending therealong for suspending said note card within said slot, and preventing said writing surface from contacting either of said surfaces of said slot.

5. The note card apparatus of claim 4 wherein said locking means comprises a pair of notches formed into opposite edges of said slot for mating with a corresponding pair of hubs extending from opposite edges of said note card.

6. The note card apparatus of claim 4 wherein said locking means comprises a portion on said planar note card sized for frictionally and securely fitting into said slot.

7. The note card apparatus of claim 1 wherein a second of said surfaces of said note card is plain and is not able to accept writing.

8. The note card apparatus of claim 7 wherein said second of said surfaces of said note card is brightly colored.

9. The note card apparatus of claim 8, further including an elongated recess extending into said housing and having an elongated writing instrument removably inserted into said elongated recess.

10. The note card apparatus of claim 1 wherein said housing is sized to be conveniently carried on a key chain in a pocket or purse.

11. A note card apparatus, comprising:

a planar rigid note card having a writing surface adapted to receive notes thereon, and an opposing surface facing in a direction opposite to the direction in which said writing surface faces, a flat rigid hollow housing having a transparent side and an opaque side, said housing having an elongated slot extending thereinto between said transparent side and said opaque side for slidably receiving said note card therein, said note card being shaped to be insertable into said slot of housing in either of first and second orientations such that, in said first orientation, said writing and opposing surfaces of said note card are adjacent said transparent and opaque sides of said housing, respectively, and in said second orientation, said writing and opposing surfaces of said note card are adjacent said transparent and opaque sides of said housing, respectively, said hollow housing and said note card including cooperating locking means for securely locking said note card within said housing for holding said note card to resist withdrawal thereof from said housing when said note card is fully inserted into said housing, but allowing said note card to be pulled from said housing by manual force, said note card having an outer edge which includes a grip portion for facilitating grasping said note card for pulling it out of said housing, a hole extending through said housing, said hole adapted to receive a holding ring, whereby said notes can be written on said writing surface when said note card is out of said housing and said note card can be inserted into said slot so that said writing surface is adjacent said transparent side so that said notes are visible therethrough, and said note card can also be inserted into said slot with said writing surface facing said opaque side so that said notes are hidden from view for security, and said housing protects said notes from accidental erasure when said note card is received therein.

12. The note card apparatus of claim 11 wherein said writing surface of said note card is made of a smooth non-porous material arranged to removably receive said notes thereon.

13. The note card apparatus of claim 12 wherein said material is plastic.

14. The note card apparatus of claim 11 wherein said elongated slot includes opposite planar surfaces and opposite side edges, each of said opposite side edges including a pair of spaced-apart shoulders extending therealong for suspending said note card within said slot, and preventing contact of said writing surface with either of said surfaces of said slot.

15. The note card apparatus of claim 11, further including an elongated recess extending into said housing and having an elongated writing instrument removably inserted into said elongated recess.

16. The note card apparatus of claim 11 wherein a second of said surfaces of said note card is plain and is not able to accept writing.

17. The note card apparatus of claim 16 wherein said second of said surfaces of said note card is brightly colored.

* * * * *